US009365040B2

(12) United States Patent
Hashimoto

(10) Patent No.: US 9,365,040 B2
(45) Date of Patent: Jun. 14, 2016

(54) LIQUID EJECTION HEAD AND IMAGE FORMING APPARATUS INCLUDING SAME

(71) Applicant: Kenichiro Hashimoto, Kanagawa (JP)

(72) Inventor: Kenichiro Hashimoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 192 days.

(21) Appl. No.: 13/972,215

(22) Filed: Aug. 21, 2013

(65) Prior Publication Data

US 2014/0055527 A1 Feb. 27, 2014

(30) Foreign Application Priority Data

Aug. 25, 2012 (JP) ..... 2012-185951

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1606* (2013.01); *B41J 2002/14411* (2013.01)

(58) Field of Classification Search
CPC ..... B41J 2/14072; B41J 2/26; B41J 2/1623; B41J 2/1631; B41J 2/164; B41J 2/1642; B41J 2/1646; B41J 2/1433
USPC ..... 347/47, 50
See application file for complete search history.

(56) References Cited

U.S. PATENT DOCUMENTS 6,488,357 B2 * 12/2002 Skinner et al. ..... 347/47
7,465,404 B2 * 12/2008 Baek et al. ..... 216/27
8,033,645 B2 * 10/2011 Van Den Berg et al. ..... 347/47
8,303,083 B2 * 11/2012 Fujii ..... B41J 2/1606 347/22
2004/0179064 A1 * 9/2004 Zapka et al. ..... 347/47
2005/0231561 A1 10/2005 Hashimoto
2006/0244770 A1 * 11/2006 Nishijima ..... 347/1
2007/0247492 A1 10/2007 Mori
2008/0143785 A1 * 6/2008 Houjou ..... B41J 2/14233 347/45
2008/0189947 A1 * 8/2008 Ohta ..... 29/890.1
2008/0313901 A1 * 12/2008 Bich et al. ..... 29/890.1
2010/0053269 A1 3/2010 Fujii et al.

(Continued)

FOREIGN PATENT DOCUMENTS

JP 2002-225298 8/2002
JP 2003-276204 9/2003
JP 2006-051808 2/2006

(Continued)

OTHER PUBLICATIONS

U.S. Appl. No. 13/780,345, filed Feb. 28, 2013.

*Primary Examiner* — Matthew Luu
*Assistant Examiner* — Patrick King
(74) *Attorney, Agent, or Firm* — Cooper & Dunham LLP

(57) ABSTRACT

A liquid ejection head includes a nozzle plate having a plurality of nozzles formed therein from which droplets are ejectable. The nozzle plate includes a nozzle substrate in which a plurality of nozzle holes each constituting a nozzle is formed, and a liquid-repellent film formed on a surface of the nozzle substrate on a droplet ejection side of the nozzle plate. A circumferential portion is formed around each nozzle on the droplet ejection side of the nozzle plate and is smoothly recessed toward an edge portion of the nozzle. The edge portion of the nozzle is smoothly continuous with an inner wall of the nozzle, and the liquid-repellent film having a uniform thickness is formed across the nozzle plate on the droplet ejection side of the nozzle plate to at least the edge portion of the nozzle.

9 Claims, 4 Drawing Sheets

(56) References Cited

U.S. PATENT DOCUMENTS

| | | | | |
|---|---|---|---|---|
| 2011/0050803 | A1* | 3/2011 | Wu et al. | 347/44 |
| 2012/0092424 | A1* | 4/2012 | Fox et al. | 347/71 |

FOREIGN PATENT DOCUMENTS

| | | |
|---|---|---|
| JP | 2008-087284 | 4/2008 |
| JP | 2011-183646 | 9/2011 |

* cited by examiner

LIQUID EJECTION HEAD AND IMAGE FORMING APPARATUS INCLUDING SAME

CROSS-REFERENCE TO RELATED APPLICATION

This patent application is based on and claims priority pursuant to 35 U.S.C. §119 to Japanese Patent Application No. 2012-185951, filed on Aug. 25, 2012, in the Japan Patent Office, the entire disclosure of which is hereby incorporated by reference herein.

BACKGROUND

1. Technical Field

Exemplary aspects of the present invention generally relate to a liquid ejection head and an image forming apparatus including the liquid ejection head.

2. Related Art

Like a printer, copier, plotter, facsimile machine, or multi-function device having two or more of these capabilities, an inkjet recording device employing a liquid ejection recording method is also a type of image forming apparatus.

Typically, the inkjet recording device includes a recording head constructed of a liquid ejection head that ejects droplets of a recording liquid such as ink onto a sheet of a recording medium to form an image on the sheet. The liquid ejection head has a nozzle face in which multiple nozzles, from which droplets are ejected, are formed. Ejection characteristics of the liquid ejection head, such as the volume and speed with which droplets are ejected from the nozzles, varies considerably depending on the shape and quality of each nozzle. It is also known that surface characteristics of a nozzle substrate, in which nozzle holes each forming the nozzle are formed, also considerably affects the ejection characteristics of the liquid ejection head. For example, adhesion of ink or the like to the area around the nozzle on the surface of the nozzle substrate may distort the trajectory of the droplets ejected from the nozzle.

To solve these problems, a liquid-repellent film is often formed on the surface of the nozzle substrate on a side from which droplets are ejected (hereinafter referred to as a droplet ejection side). As a result, the droplet ejection side of the nozzle substrate has a uniform surface across the surface of the nozzle substrate, thereby stabilizing the ejection characteristics of the liquid ejection head.

To further stabilize the ejection characteristics of the liquid ejection head, the nozzle face of the liquid ejection head is often wiped off and cleaned by an elastic blade such as a wiper formed of rubber or the like to remove liquid adhering to the portion around the nozzle during maintenance of the liquid ejection head.

However, repeated wiping of the nozzle face of the liquid ejection head abrades and wears away the liquid-repellent film around the nozzles, causing irregular ejection of the droplets from the liquid ejection head. In particular, because the wiper hits the edge of each nozzle relatively hard, the liquid-repellent film at the edge of the nozzle is easily abraded and worn away by such wiping.

To solve these problems, a concavity is often formed around the nozzle in the nozzle substrate on the droplet ejection side. However, formation of the concavity generates a step in the nozzle face, and an edge of the step is subjected to excessive load from the wiper that contacts the step, resulting in abrasion and wearing away of the liquid-repellent film at the step. In addition, it is difficult to remove viscous liquid accumulating within the concavity.

The concavity formed around the nozzle in the droplet ejection side of the nozzle substrate may be gradually tapered toward the bottom. However, although such a configuration reduces abrasion and wearing away of the liquid-repellent film at an outer circumferential part of the tapered concavity, the edge of the nozzle is still hit hard by the wiper. Consequently, durability of the liquid-repellent film at the edge of the nozzle deteriorates.

Alternatively, the thickness of the liquid-repellent film can be gradually reduced approaching the edge of each nozzle. However, such a configuration makes the liquid-repellent film excessively thin at the edge of each nozzle. Consequently, durability of the liquid-repellent film at the edge of the nozzle deteriorates, abetting abrasion and wearing away of the liquid-repellent film.

SUMMARY

In view of the foregoing, illustrative embodiments of the present invention provide a novel liquid ejection head with stable ejection characteristics and without abrasion and wearing away of a liquid-repellent film provided to the liquid ejection head, and an image forming apparatus including the liquid ejection head.

In one illustrative embodiment, a liquid ejection head includes a nozzle plate having a plurality of nozzles formed therein from which droplets are ejectable. The nozzle plate includes a nozzle substrate in which a plurality of nozzle holes each constituting a nozzle is formed, and a liquid-repellent film formed on a surface of the nozzle substrate on a droplet ejection side of the nozzle plate. A circumferential portion is formed around each nozzle on the droplet ejection side of the nozzle plate and is smoothly recessed toward an edge portion of the nozzle. The edge portion of the nozzle is smoothly continuous with an inner wall of the nozzle, and the liquid-repellent film having a uniform thickness is formed across the nozzle plate on the droplet ejection side of the nozzle plate to at least the edge portion of the nozzle.

In another illustrative embodiment, an image forming apparatus includes the liquid ejection head described above.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
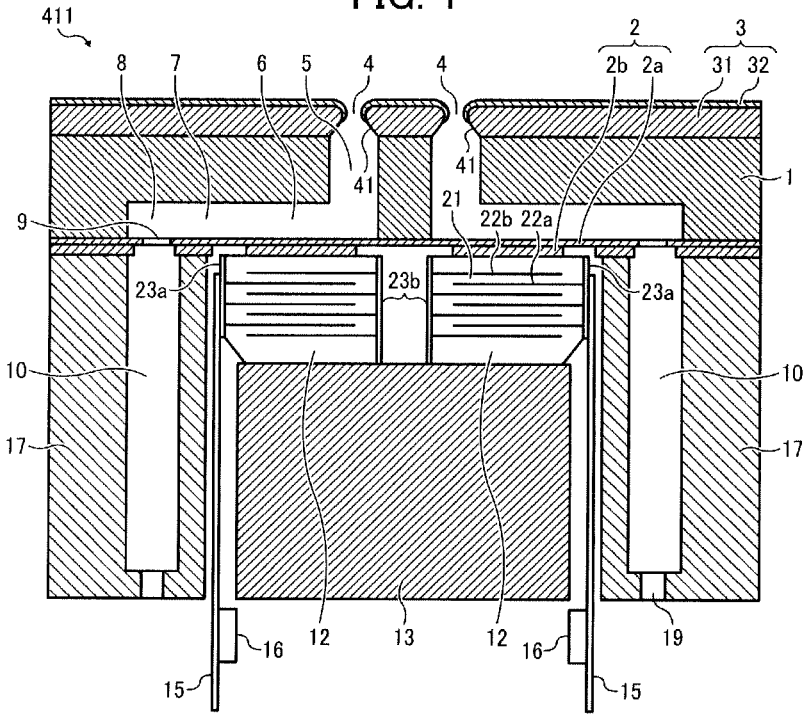
FIG. 1 is a vertical cross-sectional view illustrating an example of a configuration of a liquid ejection head along a direction perpendicular to a direction of nozzle arrays according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

It is to be noted that a "sheet" of recording media is not limited to a sheet of paper but also includes any material onto which droplets including ink droplets adhere, such as an OHP sheet, cloth, glass, and a substrate.

Image forming apparatuses hereinafter described form an image on a recording medium, such as paper, string, fiber, cloth, lather, metal, plastics, glass, wood, and ceramics by ejecting droplets onto the recording medium. In this specification, an image refers to both signifying images such as characters and figures, as well as a non-signifying image such as patterns.

In addition, ink includes any material which is a liquid when ejected from the image forming apparatuses to form images on the recording medium, such as a DNA sample, a resist material, a pattern material, and resin.

Further, an image formed on the recording medium is not limited to a flat image, but also includes an image formed on a three-dimensional object, a three-dimensional image, and so forth.

Figure 2:
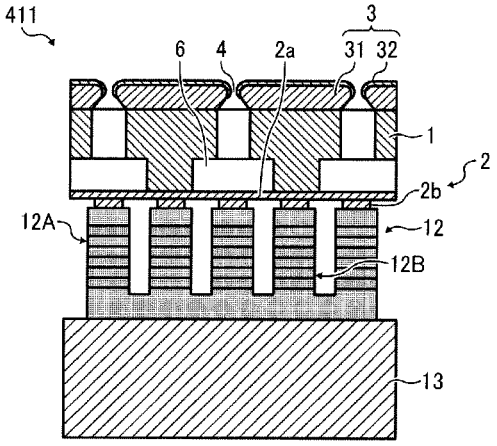
FIG. 2 is a vertical cross-sectional view of the liquid ejection head along the direction of nozzle arrays.

A description is now given of an example of a configuration of a liquid ejection head 411 according to illustrative embodiments, with reference to FIGS. 1 and 2. FIG. 1 is a vertical cross-sectional view illustrating an example of a configuration of the liquid ejection head 411 along a direction perpendicular to a direction of nozzle arrays (or a longitudinal direction of a liquid chamber 6). FIG. 2 is a vertical cross-sectional view of the liquid ejection head 411 in the direction of nozzle arrays (or a lateral direction of the liquid chamber 6).

The liquid ejection head 411 includes a channel plate (or liquid chamber substrate) 1, a vibration plate 2 bonded to a lower face of the channel plate 1, and a nozzle plate 3 bonded to an upper face of the channel plate 1.

The channel plate 1, the vibration plate 2, and the nozzle plate 3 together form multiple liquid chambers 6 communicating with, via channels 5, respective nozzles 4 formed in the nozzle plate 3 to eject droplets therefrom, fluid resistors 7 that also function as supply paths to supply liquid such as ink to the liquid chambers 6, and communication parts 8 that communicate with the liquid chambers 6 via the fluid resistors 7. Ink is supplied from a common liquid chamber 10 formed in a frame member 17, which is described in detail later, to the communication parts 8 via supply openings 9 formed in the vibration plate 2.

The channel plate 1 is formed of a silicon substrate. The silicon substrate is etched to form grooves that constitute the channels 5, the liquid chambers 6, the fluid resistors 7, and so forth. It is to be noted that, alternatively, the channel plate 1 may be formed by etching an SUS substrate using an acid etchant, or may be formed by machining such as press working.

The vibration plate 2 has vibrating portions (diaphragms) 2*a* corresponding to the respective liquid chambers 6 to form a part of the walls of the liquid chambers 6. Each of the vibrating portions 2*a* has a protrusion 2*b* on an outer surface thereof opposite to the liquid chamber 6. A drive element that deforms the vibrating portions 2*a* to generate energy to eject droplets from the nozzles 4, which, in the present illustrative embodiment, is a multi-layered piezoelectric member 12, has columnar piezoelectric elements 12A and 12B (hereinafter also referred to as piezoelectric columns 12A and 12B), and upper surface of each of the piezoelectric columns 12A and 12B is bonded to the respective protrusions 2*b*. A lower surface of the piezoelectric member 12 is bonded to a base member 13.

The piezoelectric member 12 is constructed of piezoelectric layers 21 formed of lead zirconate titanete (PZT) or the like, and internal electrodes 22*a* and 22*b*, all of which are laminated alternately. Each of the internal electrodes 22*a* and 22*b* is drawn out to end faces of the piezoelectric member 12 and is connected to external electrodes 23*a* and 23*b* provided to the respective end faces. A voltage is applied to each of the external electrodes 23*a* and 23*b* to displace the piezoelectric member 12 in a direction of lamination. Grooves are formed in the piezoelectric member 12 by half-cut dicing so that the piezoelectric member 12 has a predetermined number of the piezoelectric columns 12A and 12B positioned at predetermined intervals.

The piezoelectric columns 12A and 12B have the same basic configuration. A drive waveform is applied to the piezoelectric columns 12A (hereinafter also referred to as drive columns 12A) to drive the drive columns 12A, and no drive waveform is applied to the piezoelectric columns 12B (hereinafter also referred to as non-drive columns 12B) so that the non-drive columns 12B are used merely as columns. Either a bi-pitch configuration in which the drive columns 12A and the non-drive columns 12B are alternately used as illustrated in FIG. 2, or a normal-pitch configuration in which all the piezoelectric columns are used as the drive columns 12A, is applicable to the present illustrative embodiment.

Two arrays of drive elements, each constructed of the multiple drive columns 12A, are formed on the base member 13.

Although the piezoelectric member 12 operates in the d33 mode to pressurize liquid within the liquid chambers 6 in the present illustrative embodiment, alternatively, the piezoelectric member 12 may operate in the d31 mode to pressurize the liquid within the liquid chambers 6.

A flexible printed circuit (FPC) 15 for transmitting a drive signal is directly connected to the external electrodes 23*a* of the drive columns 12A. The FPC 15 implements a drive circuit 16 that selectively applies a drive waveform to the drive columns 12A. It is to be noted that the external electrodes 23*b* of all the drive columns 12A, which are commonly and electrically connected to one another, are connected to a common wire of the FPC 15.

The nozzle plate 3 is constructed of a nozzle substrate 31 and a liquid-repellent film 32 provided to the nozzle substrate 31 on a side from which droplets are ejected (hereinafter referred to as a droplet ejection side). Nozzle holes 41, each forming the nozzle 4 having a diameter of from 10 μm to 35 μm, is formed, corresponding to the respective liquid chambers 6, in the nozzle substrate 31.

The frame member 17 formed by injection molding using, for example, epoxy resin or polyphenylene sulfide, is bonded to outer walls of a piezoelectric actuator unit constructed of the piezoelectric member 12, to which the FPC 15 is connected, and the base member 13. The common liquid chamber 10 and supply openings 19, from which the liquid is supplied to the common liquid chamber 10, are formed in the frame member 17. The supply openings 19 are connected to a supply source such as a sub-tank or an ink cartridge, not shown.

In the liquid ejection head 411 having the above-described configuration, a voltage applied to the drive columns 12A is reduced from a reference level to contract the drive columns 12A so that the vibrating portions 2A of the vibration plate 2 are lowered to expand the volume of each of the liquid chambers 6, thereby forcing the liquid into the liquid chambers 6. Thereafter, the voltage applied to the drive columns 12A is increased to extend the drive columns 12A in the direction of lamination so that the vibrating portions 2*a* of the vibration plate 2 are deformed toward the nozzles 4 to contract the volume of each of the liquid chambers 6. As a result, pressure is applied to the liquid within the liquid chambers 6 so that droplets are ejected from the nozzles 4.

Then, the voltage applied to the drive columns 12A is returned to the reference level to restore the vibrating portions 2*a* of the vibration plate 2 to their initial positions so that the liquid chambers 6 are expanded, thereby generating negative pressure. As a result, the liquid flows from the common liquid chamber 10 to the liquid chambers 6 via the supply openings 9, so that the liquid chambers 6 are filled with the liquid. After vibration of a meniscus formed in each of the nozzles 4 is damped, the next series of ejection is started.

It is to be noted that the method for driving the liquid ejection head 411 is not limited to the above-described example, and may be varied depending on the exact manner in which the driving waveform is applied.

Figure 3:
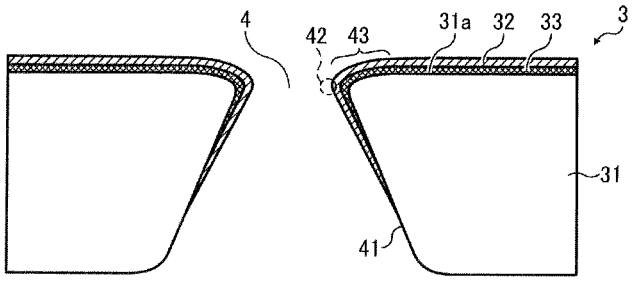
FIG. 3 is an enlarged vertical cross-sectional view illustrating a nozzle formed in a nozzle plate according to a first illustrative embodiment.

A description is now given of an example of a structure of the nozzle plate 3 according to a first illustrative embodiment, with reference to FIG. 3. FIG. 3 is an enlarged vertical cross-sectional view illustrating a portion around the nozzle 4 in the nozzle plate 3.

As described above, the nozzle plate 3 includes the nozzle substrate 31, in which the nozzle holes 41, each forming the nozzle 4, is formed. A base film 33 is formed on a surface 31*a* of the nozzle substrate 31 on the droplet ejection side, and the liquid-repellent film 32 is formed on the base film 33. In the present illustrative embodiment, the nozzle substrate 31 is formed of stainless steel.

The base film 33 improves adhesion between the nozzle substrate 31 and the liquid-repellent film 32. However, alternatively, the base film 33 may not be provided in a case in which the nozzle substrate 31 and the liquid-repellent film 32 have good adhesion therebetween.

As illustrated in FIG. 3, a diameter of each nozzle 4 is gradually reduced toward an edge portion 42 of the nozzle 4 in a direction of ejection of the droplets. A circumferential portion 43 formed around each nozzle 4 on the droplet ejection side of the nozzle plate 3 is smoothly recessed toward the edge portion 42 in a cross-section along the direction of ejection of the droplets. The edge portion 42 is smoothly continuous with an inner wall of the nozzle 4 (or an inner circumferential surface of the nozzle hole 41).

The liquid-repellent film 32 is of uniform thickness across the nozzle plate 3 to the edge portion 42 of each nozzle 4. Accordingly, a surface of the liquid-repellent film 32 is also smoothly recessed at the circumferential portion 43 toward the edge portion 42.

The thickness of the liquid-repellent film 32 from the edge portion 42 to the inner wall of the nozzle 4 (or the inner circumferential surface of the nozzle hole 41) is gradually reduced.

Figure 4A:
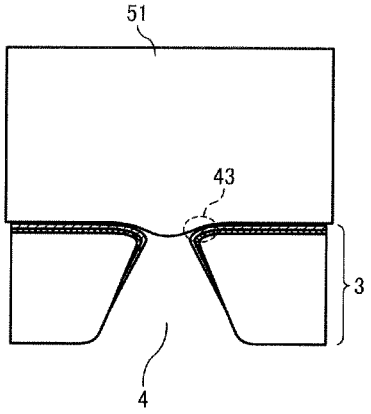
FIGS. 4A and 4B are schematic views illustrating a state of contact of a wiper with the nozzle plate viewed from different angles, respectively.
Figure 4B:
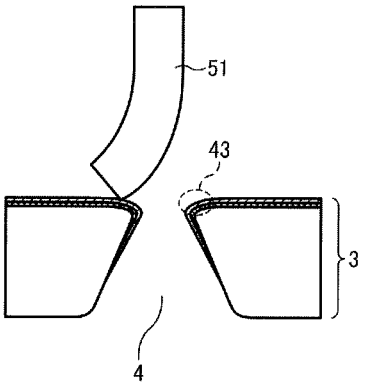

A description is now given of a state of contact of a wiper 51 with the nozzle plate 3, with reference to FIGS. 4A and 4B. FIG. 4A is a vertical cross-sectional view illustrating the state of contact of the wiper 51 with the nozzle plate 3 viewed from the front. FIG. 4B is a vertical cross-sectional view illustrating the state of contact of the wiper 51 with the nozzle plate 3 viewed from the lateral side.

As described above, in the nozzle plate 3 according to the first illustrative embodiment, the circumferential portion 43 is smoothly recessed toward the edge portion 42. Such a configuration allows the wiper 51 to securely contact the circumferential portion 43, which is smoothly recessed, without a gap therebetween, thereby reliably removing liquid from the surface of the nozzle plate 3. In addition, because there is no step or edge at the circumferential portion 43, the wiper 51 is protected from damage such as abrasion and scratches, thereby maintaining good cleaning performance over time.

To prevent deterioration in ejection performance caused by adhesion of liquid to the nozzle plate 3, the surface of the nozzle plate 3 is wiped off by the wiper 51 formed of rubber or the like to remove residual liquid from the surface of the nozzle plate 3. However, wiping of the surface of the nozzle plate 3 by the wiper 51 may abrade or tear off the liquid-repellent film 32 formed on the surface 31*a* of the nozzle substrate 31.

To prevent this problem, on the surface of the nozzle plate 3, the circumferential portion 43 is smoothly recessed toward the edge portion 42. Accordingly, the wiper 51 contacts the circumferential portion 43 with reduced pressure, thereby reducing damage to the circumferential portion 43 caused by wiping.

The edge portion 42 of the nozzle 4 is curved and smoothly continuous with both the inner wall of the nozzle 4 and the surface of the nozzle plate 3. The liquid-repellent film 32 formed on the edge portion 42, which is provided between and connects both the surface of the nozzle plate 3 and the inner wall of the nozzle 4, tends to be damaged by the wiper 51. However, as described above, the edge portion 42 is smoothly curved, thereby reducing damage such as abrasion and tearing off of the liquid-repellent film 32 caused by the wiper 51.

In addition, the liquid-repellent film 32 is continuously formed from the edge portion 42 to the inner wall of the nozzle 4, thereby preventing the liquid-repellent film 32 from tearing off by the wiper 51.

Specifically, a part of each of the liquid-repellent film 32 and the base film 33 enters the nozzle hole 41 to be smoothly continuous with the inner wall of the nozzle 4, so that the edge portion 42 of the nozzle 4 is covered with the liquid-repellent film 32 and the base film 33 and presents no open edge to the wiper 51.

The liquid-repellent film 32 has a uniform thickness across the surface 31*a* of the nozzle substrate 31 as described above. Accordingly, in the manufacture of the nozzle plate 3 using a method described later, the reaction of steam with air and thermal conductivity during heating are uniform on the surface 31*a* of the nozzle substrate 31, thereby providing the liquid-repellent film 32 with uniform repellency, durability, and adhesion to the surface 31*a* of the nozzle substrate 31.

In addition, the circumferential portion 43 formed on the droplet ejection side of the nozzle plate 3 is smoothly recessed toward the edge portion 42 of the nozzle 4. Accordingly, damage to the wiper 51 is also reduced.

Specifically, an edge of the nozzle 4 or concavities in the surface of the nozzle plate 3 can abrade the wiper 51 at certain parts thereof, possibly causing irregular wiping of the surface of the nozzle plate 3. Consequently, liquid remains adhered onto the nozzle plate 3 in a stripe pattern in a direction of movement of the wiper 51.

As a result, such liquid, which becomes viscous and is fixed onto the surface of the nozzle plate 3, is spread across the surface of the nozzle plate 3 by the wiping movement of the wiper 51 and may adhere around the nozzle 4, causing irregular ejection of the droplets from the nozzle 4.

To solve these problems, in the present illustrative embodiment, the circumferential portion 43 formed around the nozzle 4 is smoothly recessed toward the edge portion 42 of the nozzle 4. As a result, abrasion of the wiper 51 is prevented, thereby preventing irregular ejection of the droplets from the nozzle 4.

Further, even in a case in which sheet jam or the like causes the sheet to directly contact the nozzle face of the liquid ejection head 411, the circumferential portion 43, which is smoothly recessed toward the edge portion 42 of the nozzle 4, hinders such sheet from directly hitting the area around the nozzle 4.

Figure 5:
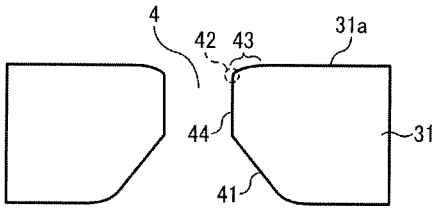
FIG. 5 is an enlarged vertical cross-sectional view illustrating an example of a structure of a nozzle substrate according to a second illustrative embodiment.

A description is now given of a second illustrative embodiment, with reference to FIG. 5. FIG. 5 is a vertical cross-sectional view illustrating an example of a structure of the nozzle base 31 according to the second illustrative embodiment.

In the second illustrative embodiment, the nozzle hole 41 formed in the nozzle substrate 31 further includes a linear portion 44 on the droplet ejection side of the nozzle plate 3. The linear portion 44 is parallel to the direction of ejection of the droplets from the nozzle 4. Although not shown in FIG. 5 for ease of illustration, the liquid-repellent film 32 and the base film 33 are formed on the nozzle substrate 31 in a manner similar to the first illustrative embodiment.

It is known that the diameter of each nozzle considerably affects the ejection performance of the liquid ejection head. Uneven amount of recession in the circumferential portion 43 around each nozzle 4 and uneven size of the curve in the edge portion 42 of each nozzle 4 may vary the diameter of the nozzles 4. Consequently, each nozzle 4 has a slightly different diameter, causing uneven ejection performance of the liquid ejection head 411.

Provision of the linear portion 44 to the nozzle hole 41 fixes the diameter of the nozzle 4 even when the amount of recession in the circumferential portion 43 and the size of the curve in the edge portion 42 vary, thereby achieving uniform ejection performance of the liquid ejection head 411.

A description is now given of an example of a method for manufacturing the nozzle plate 3 according to the second illustrative embodiment. FIGS. 6A to 6H are schematic views illustrating steps in a process of manufacturing the nozzle plate 3, respectively. It is to be noted that, the steps of manufacturing the nozzle plate 3 are substantially the same in both the first and second illustrative embodiments, differing only in a shape of a puncher used for press working.

Figure 6A:
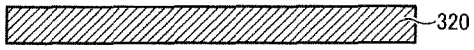
FIGS. 6A to 6H are schematic views respectively illustrating steps in a process of manufacturing a nozzle plate according to the second illustrative embodiment.

First, a stainless steel plate 320 of a thickness of, for example, 50 μm, is prepared as illustrated in FIG. 6A. In the present example, stainless steel 316 is used for the plate 320.

Figure 6B:
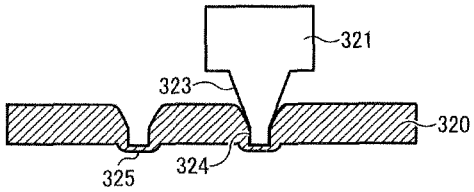

As illustrated in FIG. 6B, a puncher 321 having a tapered portion 323 and a linear portion 324 is used to form the nozzle 4 by press working.

Figure 6C:
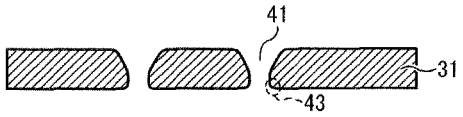

A protrusion 325 formed by press working is polished away, such that the nozzle substrate 31 having the nozzle hole 41 is formed as illustrated in FIG. 6C. At this time, a circumference of the nozzle hole 41 on the droplet ejection side of the nozzle substrate 31 is smoothly recessed by polishing to form the circumferential portion 43.

Figure 6D:
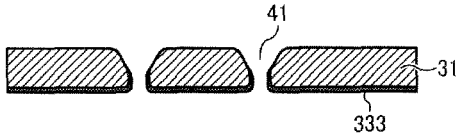

Next, for example, an $SiO_2$ layer 333 of 10 nm thickness, which forms the base film 33 of the liquid-repellent film 32, is formed on the droplet ejection side of the nozzle substrate 31 by sputtering as illustrated in FIG. 6D.

Figure 6E:
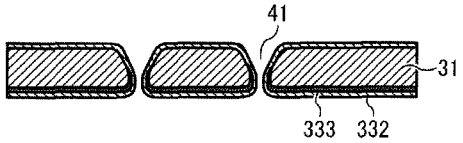

The nozzle substrate 31 thus formed is then soaked for an hour in a solution in which fluorine-based solvent is mixed with 0.02 wt % modified perfluoropolyoxy-etane. Then, the nozzle substrate 31 is heated at 130° C. for 10 minutes. Thereafter, the nozzle substrate 31 is rinsed with fluorine-based solvent, so that an excess amount of the $SiO_2$ layer 333, which is not bonded to the surface of the nozzle substrate 31, is removed to form a fluorinated liquid-repellent layer 332 as illustrated in FIG. 6E. Modified perfluoropolyoxyetane reacts with steam in air to link with the surface of the $SiO_2$ layer 333.

Figure 6F:
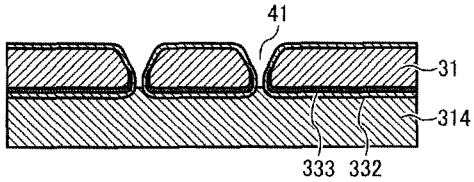

Next, a protective material 314 is bonded to the droplet ejection side of the nozzle substrate 31 as illustrated in FIG. 6F.

Figure 6G:
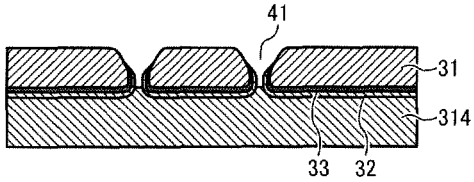

A liquid chamber side of the nozzle substrate 31, which is opposite to the droplet ejection side and to which the protective material 314 is not bonded, is irradiated with $O_2$ plasma. As a result, the liquid-repellent layer 332 entering the liquid chamber side of the nozzle substrate 31 through the nozzle hole 41 is removed, so that the liquid-repellent film 32 and the base film 33 are formed on the droplet ejection side of the nozzle substrate 31 as illustrated in FIG. 6G.

Figure 6H:
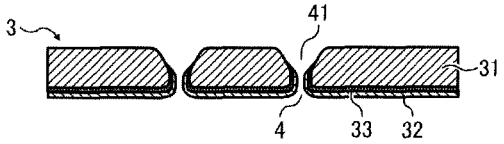

Thereafter, the protective material 314 is removed to form the nozzle plate 3 as illustrated in FIG. 6H.

It is to be noted that chemical abrasive polishing is used in the step of polishing illustrated in FIG. 6C. In chemical abrasive polishing, chemical abrasion is used in addition to mechanical polishing, so that the nozzle substrate 31 is chemically etched to remove minute scratches and burrs therefrom, thereby improving smoothness of the nozzle substrate 31.

In chemical abrasive polishing, an acute portion is particularly polished by chemical treatment and polishing pressure. As a result, the edge around the nozzle 4 is polished smoother than a flat portion. Therefore, the circumferential portion 43 around the nozzle 4 is smoothly recessed as described above. In addition, a corner between the surface of the nozzle plate 3 and the linear portion 44 of the nozzle 4 is chamfered by polishing. As a result, the surface of the nozzle plate 3 and the linear portion 44 are smoothly continuous with each other. Thus, manufacture of the nozzle plate 3 according to the second illustrative embodiment is facilitated.

Alternatively, the liquid-repellent layer 332 may be formed by vacuum deposition. It is to be noted that the liquid-repellent layer 332 still enters the nozzle hole 41 and the liquid chamber side of the nozzle substrate 31 in the vacuum deposition.

In the present illustrative embodiment, fluorinated liquid-repellent material is used as a liquid repellent. Although various materials are known as fluorinated (fluoroalkyl alkoxysilane) repellents, in the present illustrative embodiment, modified perfluoropolyoxyetane, perfluoropolyoxyetane variant, or a mixture of both (product name: OPTOOL DSX, manufactured by Daikin Industries, Ltd.; also known as terminal-modified alkoxysilane perfluoropolyether), is deposited with a thickness of between 5 nm and 20 nm to obtain the desired liquid repellency.

When the nozzle plate 3 is taken out of a deposition chamber after the deposition of the liquid-repellent layer 332, the fluorinated repellent and the $SiO_2$ layer, that is, the base film 33, are hydrolyzed by moisture in air and chemically linked with $SiO_2$, so that the fluorinated liquid-repellent film 32 is formed.

Figure 7:
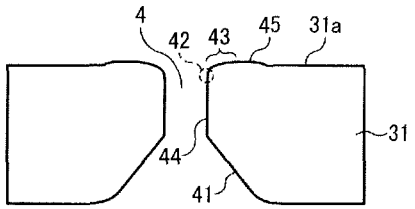
FIG. 7 is an enlarged vertical cross-sectional view illustrating an example of a structure of a nozzle substrate according to a third illustrative embodiment.

A description is now given of a third illustrative embodiment, with reference to FIG. 7.

FIG. 7 is an enlarged vertical cross-sectional view illustrating an example of a structure of the nozzle substrate 31 according to the third illustrative embodiment. In the third illustrative embodiment, a bulge 45 is formed on the surface 31*a* of the nozzle substrate 31 toward the direction of ejection of the droplets around the nozzle 4 on the nozzle substrate 31. A part of the bulge 45 is smoothly recessed to form the circumferential portion 43 around the nozzle 4.

Although not shown in FIG. 7 for ease of illustration, the liquid-repellent film 32 and the base film 33 are formed on the nozzle substrate 31 in a manner similar to the first illustrative embodiment.

In the third illustrative embodiment, an amount of polishing of the surface 31*a* of the nozzle substrate 31 is controlled in the method for manufacturing the nozzle plate 3 described above in the second illustrative embodiment.

As a result, the wiper 51 securely contacts the circumferential portion 43 around the nozzle 4 even in a case in which the nozzle plate 3 is bent.

Specifically, during the manufacture or assembly of the liquid ejection head 411, the nozzle plate 3 may be bent. Consequently, the bent nozzle plate 3 hinders secure contact between the surface of the nozzle plate 3 and the wiper 51 during the wiping, causing irregular wiping of the nozzle plate 3. The irregular wiping around the nozzle 4 causes adherence of liquid around the nozzle 4, resulting in irregular ejection of droplets from the nozzle 4.

To solve these problems, in the third illustrative embodiment, the bulge 45 is provided around the nozzle 4 as illustrated in FIG. 7. Accordingly, the wiper 51 securely contacts the portion around the nozzle 4 during the wiping. A portion from the bulge 45 to the nozzle 4 is smoothly recessed to form the circumferential portion 43. As a result, the load of wiping is reduced at the portion around the nozzle 4, thereby increasing durability of the liquid-repellent film 32 around the nozzle 4.

Figure 8:
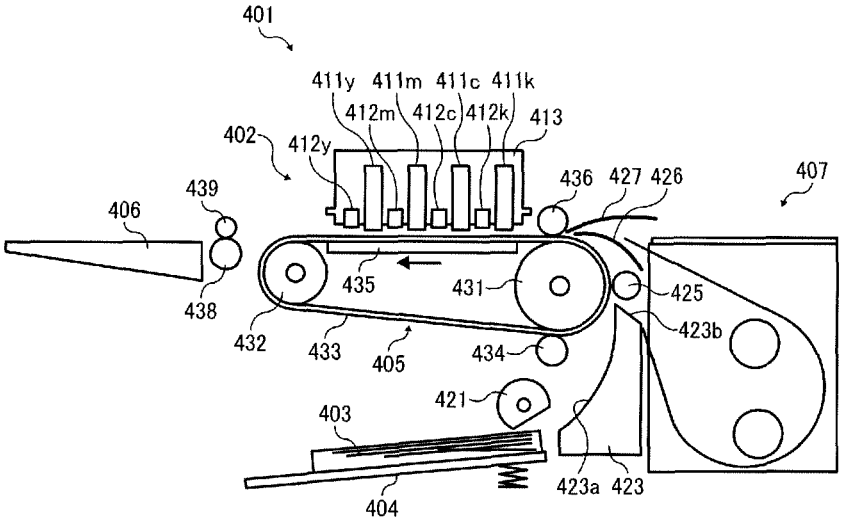
FIG. 8 is a vertical cross-sectional view illustrating an example of a configuration of an image forming apparatus according to illustrative embodiments.

A description is now given of an example of a configuration and operation of the image forming apparatus 401 including the liquid ejection head 411 according to the foregoing illustrative embodiments, with reference to FIG. 8. FIG. 8 is a schematic view illustrating an example of a configuration of a mechanical portion of the image forming apparatus 401.

The image forming apparatus 401 is a line-type inkjet recording device and includes an image forming part 402 and a sheet tray 404 disposed in a lower part of the image forming apparatus 401. The sheet tray 404 accommodates a stack of multiple sheets 403.

The image forming part 402 forms images on the sheets 403 fed from the sheet tray 404 while the sheets 403 are being conveyed by a conveyance mechanism 405. Thereafter, the sheets 403 having the images thereon are discharged from the image forming apparatus 401 to a discharge tray 406 provided to a lateral side of the image forming apparatus 401.

The image forming apparatus 401 further includes a duplex unit 407 detachably attachable to the image forming apparatus 401. During duplex image formation, the sheet 403 having the image on a front side thereof is conveyed backward by the conveyance mechanism 405 to the duplex unit 407. The duplex unit 407 reverses and conveys the sheet 403 to the conveyance mechanism 405 such that an image is formed on a back side of the sheet 403 by the image forming part 402. The sheet 403 having the images on both sides thereof is then discharged to the discharge tray 406.

The image forming part 402 includes recording heads 411*k*, 411*c*, 411*m*, and 411*y*, each constituted of the full-line type liquid ejection head 411 according to the foregoing illustrative embodiments (hereinafter also collectively referred to as recording heads 411). Each of the recording heads 411 ejects ink droplets of a specific color, that is, black (k), cyan (c), magenta (m), or yellow (y).

Each recording head 411 is attached to a head holder 413 such that the nozzle face of each recording head 411 having nozzle arrays, each constituted of the multiple nozzles 4, faces downward. It is to be noted that, examples of the full-line type liquid ejection head include a configuration in which a single liquid ejection head is used to form a single line of an image, and a configuration in which multiple liquid ejection heads are arranged in a zigzag pattern to form a single line of an image.

Maintenance/recovery mechanisms 412*k*, 412*c*, 412*m*, and 412*y* (hereinafter collectively referred to as maintenance/recovery mechanisms 412) that maintain the performance of the recording heads 411 are provided for the respective recording heads 411.

During maintenance of the recording heads 411 such as purging and wiping, the maintenance/recovery mechanism 412 and the corresponding recording head 411 are moved relative to each other, so that a capping member and so forth included in each maintenance/recovery mechanism 412 face the nozzle face of the recording head 411.

Although the recording heads 411*k*, 411*c*, 411*m*, and 411*y* are disposed, in that order, from upstream to downstream in a direction of conveyance of the sheet 403 in the example illustrated in FIG. 8, the arrangement of the recording heads 411 and the number of colors used are not limited thereto.

In addition, each recording head 411 may be formed either individually or together with a liquid cartridge, which supplies liquid to the recording head 411, as a single integrated unit.

A sheet feed roller 421 and a separation pad, not shown, separate the sheets 403 in the sheet tray 404 one by one to feed each sheet 403 between a conveyance belt 433 of the conveyance mechanism 405 and a registration roller 425 along a first guide surface 423*a* of a guide member 423. Thereafter, the sheet 403 is conveyed to the conveyance belt 433 via a guide member 426 at a predetermined timing.

The guide member 423 also has a second guide surface 423*b* that guides the sheet 403 conveyed from the duplex unit 407. The image forming apparatus 401 further includes a guide member 427 that guides the sheet 403 returned from the conveyance mechanism 405 to the duplex unit 407 during duplex image formation.

The conveyance mechanism 405 includes the endless conveyance belt 433 wound around a drive roller, that is, a conveyance roller 431, and a driven roller 432, a charging roller 434 that charges the conveyance belt 433, a platen member 435 that flattens the conveyance belt 433 at a portion opposite the image forming part 402, a pressing roller 436 that presses the sheet 403 conveyed by the conveyance belt 433 against the conveyance roller 431, and a cleaning roller including a porous body, not shown, that removes liquid such as ink from the conveyance belt 433.

A discharge roller 438 and a spur 439, each of which discharges the sheet 403 having the image thereon to the discharge tray 406, are provided downstream from the conveyance mechanism 405.

The conveyance belt 433 rotated counterclockwise in FIG. 8 is contacted and charged by the charging roller 434, to which a high voltage is applied. As a result, the sheet 403 conveyed to the conveyance belt 433 thus charged is electrostatically attracted to the conveyance belt 433. A curl and unevenness in the sheet 403, which is strongly attracted to the conveyance belt 433, are corrected to give a flatness to the sheet 403.

The recording heads 411 eject the droplets onto the sheet 403 while the sheet 403 is moved as the conveyance belt 433 rotates. As a result, an image is formed on the sheet 403. Thereafter, the sheet 403 having the image thereon is discharged to the discharge tray 406 by the discharge roller 438.

Thus, the image forming apparatus 401 including the liquid ejection heads 411 according to the foregoing illustrative embodiments can securely provide higher-quality images at higher speed.

The foregoing illustrative embodiments are applicable to either serial-type image forming apparatuses or to the line-type image forming apparatuses.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A liquid ejection head, comprising:

a nozzle plate having a plurality of nozzles formed therein from which droplets are ejectable, comprising:

a nozzle substrate in which a plurality of nozzle holes, each nozzle hole constituting a nozzle, is formed;

a base film formed on a surface of the nozzle substrate on a droplet ejection side of the nozzle plate, the base film also having been formed on an inner wall of the nozzle hole; and a liquid-repellent film formed on the base film on the droplet ejection side of the nozzle plate; and a circumferential portion around each nozzle on the droplet ejection side of the nozzle plate smoothly recessed toward an edge portion of the nozzle, wherein the edge portion of the nozzle is smoothly continuous with the inner wall of the nozzle hole, and the nozzle hole extending from the droplet ejection side of the nozzle plate to an opposite side of the nozzle plate, wherein the liquid-repellent film has a uniform thickness formed across the nozzle plate on the droplet ejection side of the nozzle plate to at least the edge portion of the nozzle, wherein the liquid-repellent film is formed also on the inner wall of the nozzle hole, and the liquid-repellent film formed also on the inner wall of the nozzle hole is gradually thinned in a direction reverse to that in which the droplets are ejected from the nozzle hole, and wherein the liquid-repellant film extends farther than the base film in the direction reverse to that in which the droplets are ejected from the nozzle hole, and extension of the liquid-repellent film in the reverse direction ends prior to reaching the opposite side of the nozzle plate.

2. The liquid ejection head according to claim 1, wherein the inner wall of the nozzle hole has a linear portion parallel to a direction of ejection of droplets on the droplet ejection side of the nozzle plate.

3. The liquid ejection head according to claim 2, wherein the circumferential portion bulges outward from the nozzle plate on the droplet ejection side of the nozzle plate in the direction of ejection of droplets, and then is smoothly recessed toward the edge portion of the nozzle.

4. An image forming apparatus comprising a liquid ejection head, the liquid ejection head comprising:

a nozzle plate having a plurality of nozzles formed therein from which droplets are ejectable, comprising:

a nozzle substrate in which a plurality of nozzle holes, each nozzle hole constituting a nozzle, is formed;

a base film formed on a surface of the nozzle substrate on a droplet ejection side of the nozzle plate, the base film also having been formed on an inner wall of the nozzle hole; and a liquid-repellent film formed on the base film on the droplet ejection side of the nozzle plate; and a circumferential portion around each nozzle on the droplet ejection side of the nozzle plate smoothly recessed toward an edge portion of the nozzle, wherein the edge portion of the nozzle is smoothly continuous with the inner wall of the nozzle hole, and the nozzle hole extending from the droplet ejection side of the nozzle plate to an opposite side of the nozzle plate, wherein the liquid-repellent film has a uniform thickness formed across the nozzle plate on the droplet ejection side of the nozzle plate to at least the edge portion of the nozzle, and wherein the liquid-repellent film is formed also on the inner wall of the nozzle hole, and the liquid-repellent film formed also on the inner wall of the nozzle hole is gradually thinned in a direction reverse to that in which the droplets are ejected from the nozzle hole, and wherein the liquid-repellant film extends farther than the base film in the direction reverse to that in which the droplets are ejected from the nozzle hole, and extension of the liquid-repellent film in the reverse direction ends prior to reaching the opposite side of the nozzle plate.

5. The liquid ejection head according to claim 1, wherein the edge portion of the nozzle forms a smooth, but acute, transition from the surface of the nozzle substrate to the inner wall of the nozzle hole.

6. A liquid ejection head, comprising:

a nozzle plate having a plurality of nozzles formed therein from which droplets are ejectable, comprising:

a nozzle substrate in which a plurality of nozzle holes, each nozzle hole constituting a nozzle, is formed;

a base film formed on a surface of the nozzle substrate on a droplet ejection side of the nozzle plate, the base film also having been formed on an inner wall of the nozzle hole; and a liquid-repellent film formed on the base film on the droplet ejection side of the nozzle plate; and wherein for each nozzle hole amongst the plurality of nozzle holes, the surface of the nozzle substrate on the droplet ejection side is curved toward an edge portion of the nozzle hole at a circumference around the nozzle hole on the droplet ejection side, and the nozzle hole extending from the droplet ejection side of the nozzle plate to an opposite side of the nozzle plate, the surface of the nozzle substrate on the droplet ejection side and the inner wall of the nozzle substrate are connected smoothly by the edge portion, and the liquid-repellent film has a uniform thickness to at least the edge portion of the nozzle hole, and wherein the liquid-repellent film is formed also on the inner wall of the nozzle hole, and the liquid-repellent film formed also on the inner wall of the nozzle hole is gradually thinned in a direction reverse to that in which the droplets are ejected from the nozzle hole, and wherein the liquid-repellant film extends farther than the base film in the direction reverse to that in which the droplets are ejected from the nozzle hole, and extension of the liquid-repellent film in the reverse direction ends prior to reaching the opposite side of the nozzle plate.

7. The liquid ejection head according to claim 6, wherein the base film becomes gradually thinner in the direction reverse to that in which the droplets are ejected from the nozzle hole.

8. The liquid ejection head according to claim 1, wherein the base film becomes gradually thinner in the direction reverse to that in which the droplets are ejected from the nozzle hole.

9. The image forming apparatus according to claim 4, wherein the base film becomes gradually thinner in the direction reverse to that in which the droplets are ejected from the nozzle hole.

* * * * *